United States Patent [19]

Funk

[11] 4,181,342

[45] Jan. 1, 1980

[54] SELF RELEASING SLING HOIST

[75] Inventor: Charles F. Funk, Gulfport, Miss.

[73] Assignee: Met-L-Parts, Inc., Gulfport, Miss.

[21] Appl. No.: 879,122

[22] Filed: Feb. 21, 1978

[51] Int. Cl.[2] ..... B66C 1/12

[52] U.S. Cl. ..... 294/75; 294/83 R

[58] Field of Search ..... 294/75, 83 R, 81, 190, 294/115

[56] References Cited

U.S. PATENT DOCUMENTS

| | | | |
|---|---|---|---|
| 1,994,646 | 3/1935 | Heath | 294/83 R |
| 2,813,744 | 11/1957 | Hutchinson | 294/75 |
| 2,825,598 | 3/1958 | Nickolai | 294/75 |

*Primary Examiner*—James B. Marbert

*Attorney, Agent, or Firm*—Marvin B. Eickenroht; Jennings B. Thompson

[57] ABSTRACT

A self releasing sling hoist is disclosed that includes a body for connecting to a hoist line for lifting a load. A sling such as a flexible line or cable has one end attached to one side of the body. The other end is provided with a loop or opening for attaching to a hook connected to the other side of the body after the sling has been passed under or otherwise arranged to support a load. A releasing arm is connected to the body to pivot toward the hook under the influence of the load as the weight of the load is transferred from the sling and the body is lowered toward the load. Continued downward movement of the body relative to the load will cause the release arm to pivot past the hook and force the end of the sling off the hook thereby automatically releasing the sling from the load.

4 Claims, 3 Drawing Figures

SELF RELEASING SLING HOIST

This invention relates to hoisting apparatus and, in particular, to such apparatus that employ a sling to support the load.

Many types of materials, such as tubular goods, logs, and the like, are moved from place to place, either singly or in bundles, by passing a sling beneath the material and connecting the free ends of the sling to hoisting apparatus, usually a hook. In some instances, one end of the sling is attached to the hook more or less permanently and the other end provided with a loop or opening which is hung on the hook after the sling has been positioned under the load. Alternatively, the sling can be provided with loops or openings at both ends and both ends are hung on the hook to support the load.

When the load has reached the desired location and has been lowered onto a supporting surface, such as the bed of a truck, pipe rack, or the ground, it is necessary to remove the sling from beneath the load. Often the hoist operators rely on the downward movement of the hook after the weight of the load has been transferred to another supporting surface to cause the end of the sling to move off the hook. Many times, however, this doesn't happen and a worker has to climb up on the load and remove the end of the sling from the hook. This is the cause of many industrial accidents. It also wastes time.

It is an object of this invention to provide a sling hoist that will automatically release one end of the sling as the hoist is lowered toward the load when the load has been lowered onto the desired supporting surface.

It is another object of this invention to provide a sling hoist having a hook for supporting one end of the sling and a releasing arm that is moved upwardly past the hook by the load when the hoist is lowered toward the load to force the end of the sling off the hook.

These and other objects, advantages, and features of this invention will be apparent to those skilled in the art from a consideration of this specification, including the attached drawings and appended claims.

IN THE DRAWINGS

Figure 1:
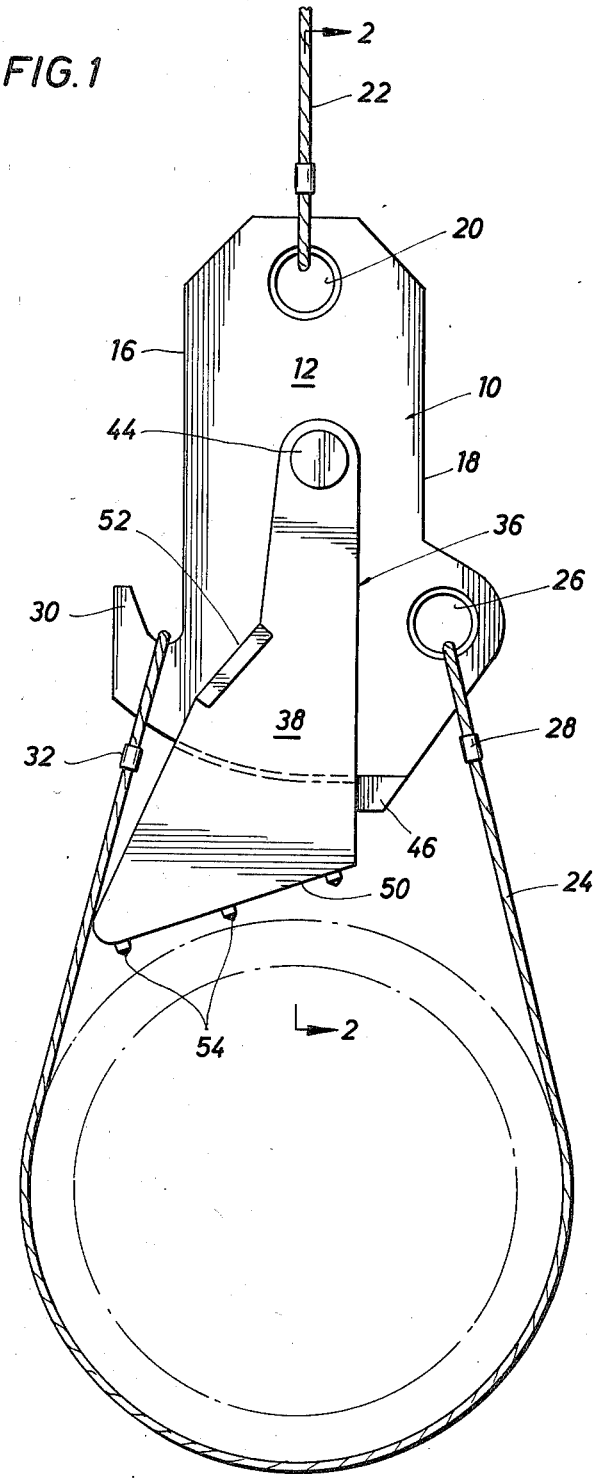
FIG. 1 is a view in elevation of the preferred embodiment of the sling hoist of this invention supporting a tubular member by a sling comprising a single flexible line.
Figure 2:
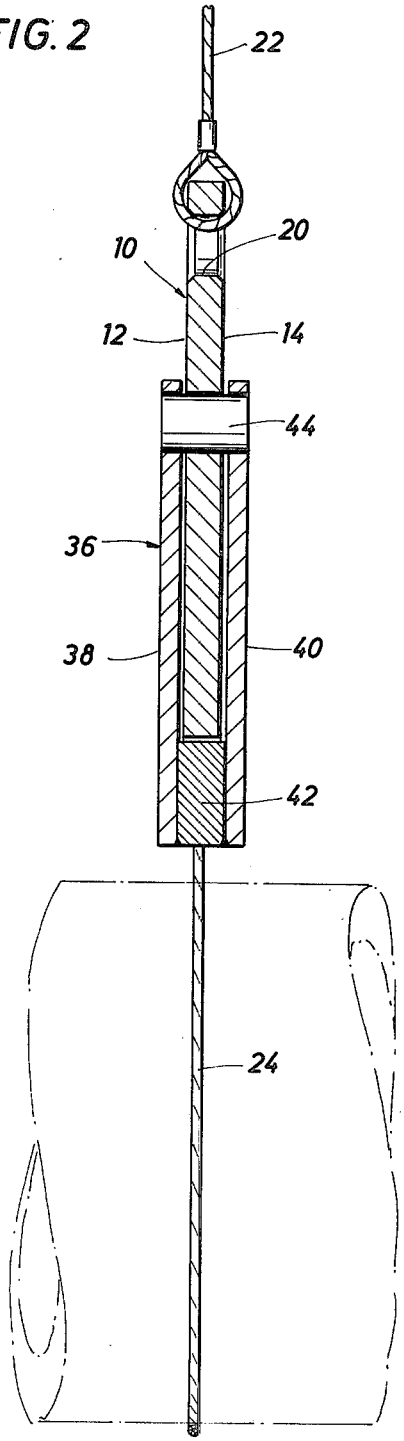
FIG. 2 is a sectional view taken along line 2—2 of FIG. 1.
Figure 3:
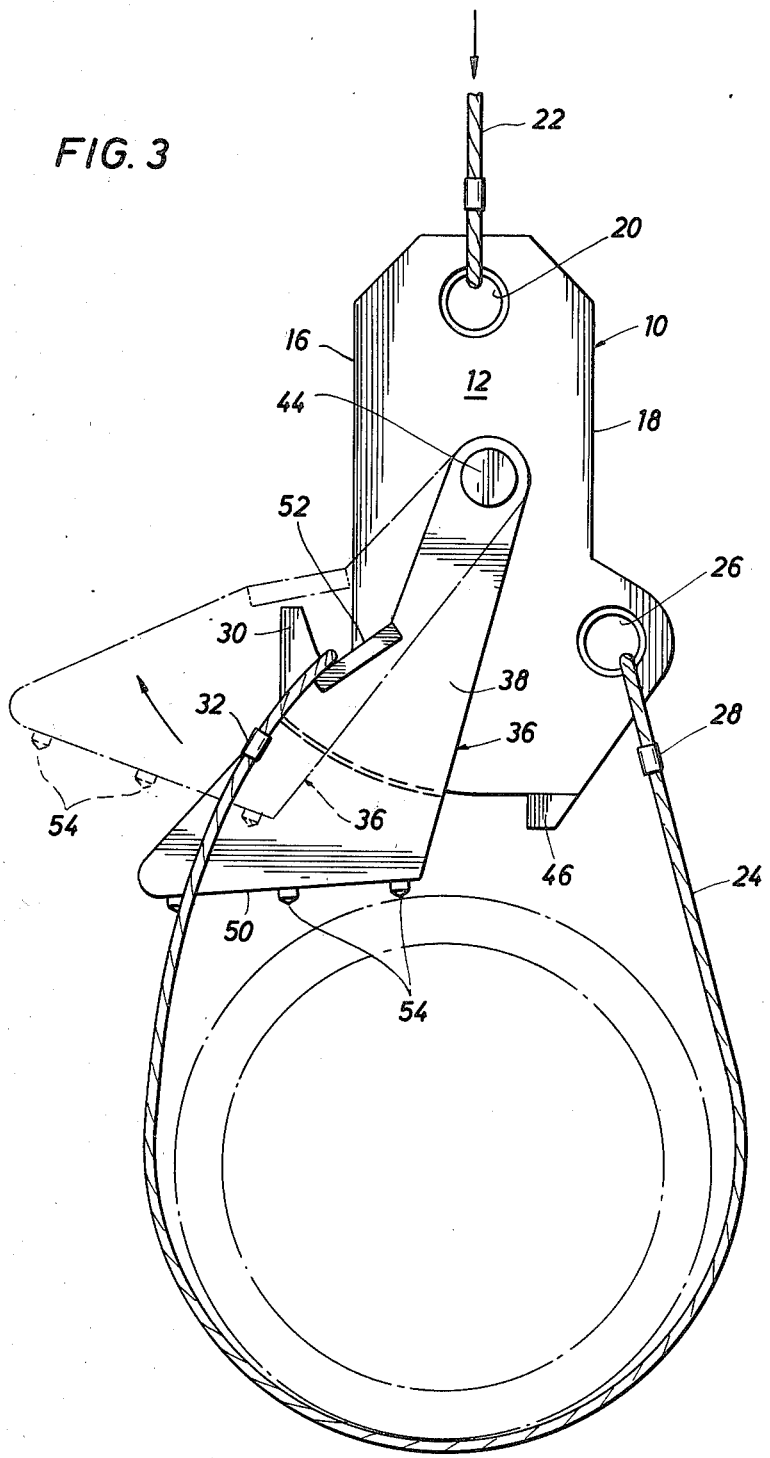
FIG. 3 is a view similar to FIG. 1 showing the movement of the releasing arm that moves the end of the sling off the hook to release the sling from the load.

The self releasing cable hoist of this invention includes body 10, a side view of which is shown in FIGS. 1 and 3. The body is generally rectangular in cross-section in a horizontal plane and has relatively wide vertical sides 12 and 14 and relatively narrow edges 16 and 18. Opening 20 is provided adjacent the upper end of the body for connecting the body to hoisting line 22 in the manner shown.

In the embodiment shown, the sling comprises flexible line or cable 24, which has one end looped through opening 26 and clamped by clamp 28 to attach this end of the cable to the body. In the embodiment shown, edge 18 of the body protrudes laterally to allow opening 26, which is located in the protuberance to be spaced sufficiently from the vertical center line of the body to provide room for the releasing arm to be described below.

Hook 30 is integrally connected to edge 16 of the body adjacent its lower end. The other end of flexible cable 24 is looped and clamped by clamp 32 to form an opening to receive hook 30, i.e., the looped end is positioned over hook 30 as shown in FIG. 1 after it has passed below the load to be supported. The load is shown in the drawings as being a single tubular member but, as explained above, it could also be a bundle of tubular members of smaller diameter, a bundle of logs, etc.

After flexible line or sling 24 has been moved under the load and its looped end passed over hook 30 the hoist can pick up on hoist line 22 and the load can be moved to the desired location. Means are provided to move the looped end of cable 24 off of hook 30 to release the load when the downward movement of the load is stopped and the body is lowered toward the load. In the embodiment shown, this releasing means includes releasing arm 36. The arm includes side plates 38 and 40 that are held in spaced position by spacer 42. This provides a bifurcated structure that can be positioned with side plates 38 and 40 on opposite sides of the body as shown. The arm is attached to the body for pivotal movement by pin 44 which extends through the body and through the side plates of the arm. Basically the arm is designed to hang below body 10 but above the load when the load is being supported on the cable as shown in FIG. 1 and to be forced by the load to pivot toward hook 30 to force the looped end of the cable off the hook as the body of the hoist is lowered toward the load, in the manner shown in FIG. 3.

To insure that the arm pivots in the proper direction, stop 46 is attached to the lower end of body 10 to engage spacer 42 and prevent the arm from pivoting counter clockwise as viewed in FIGS. 1 and 3 past the stop. As can be seen from the drawings, side plates 38 and 40 are shaped to provide a downwardly inclined lower edge 50 to engage the load. Being inclined in this direction, the component of the force imposed on this edge by the load will tend to cause the arm to pivot clockwise, as viewed in FIGS. 1 and 3. Also the arms are provided with appropriate surfaces 50, only one of which is shown in the drawings, having inserts of wear resistant material to engage the sling as the arm moves past the hook.

Preferable, the side plates are shaped for the center of gravity of the arm and the stop to be positioned on opposite sides of a vertical plane through the axis of rotation of the arm. This causes the arm to tend to swing toward the stop and away from the hook when it is supported by pin 44 and the body.

To insure that the arm doesn't slide off the load and not pivot to the desired extent, protuberances 54 are spaced along lower edge 50 to help prevent slippage. As shown, these protuberances are in the form of pointed spikes which are particularly advantageous when the hoist is being used to move logs.

In summary and as shown in FIG. 3, as the weight of the load supported by the hoist is transferred to a supporting surface (not shown) continued downward movement of body 10 toward the load will cause release arm 36 to be forced to pivot in a clockwise direction by the load as the arm engages the load. This will move the arm past hook 30 forcing the looped end of sling line 24 off the hook releasing the line to be pulled from beneath the load by upward movement of body 10.

From the foregoing, it will be seen that this invention is one well adapted to attain all of the ends and objects hereinabove set forth, together with other advantages which are obvious and which are inherent to the apparatus and structure.

It will be understood that certain features and sub-combinations are of utility and may be employed without reference to other features and sub-combinations. This is contemplated by and is within the scope of the claims.

As many possible embodiments may be made of this invention without departing from the scope thereof, it is to be understood that all matter herein set forth or shown in the accompanying drawings is to be interpreted as illustrative and not in a limiting sense.

The invention having been described, what is claimed is:

1. A self releasing sling hoist comprising a body for attaching to a hoist, a hook attached to the body, a sling having one end attached to the body and the other end having an opening for receiving the hook to support a load below the body, and means for moving the end of the sling off the hook to release the load when the downward movement of the load is stopped and the body is lowered toward the load, said releasing means including a releasing arm pivotally attached to the body and extending below the body in position to engage the load and to be pivoted relative to the body by the load in an arcuate path past the hook forcing the end of the sling off the hook as the body moves toward the load.

2. The sling hoist of claim 1 in which the body is generally rectangular in horizontal cross section having relatively wide vertical sides and relatively narrow edges and in which the sling has its one end connected to the body adjacent one edge and the hook is attached to the opposite edge and in which the releasing arm is a bifurcated member having two spaced portions positioned on opposite sides of the vertical sides of the body, and a lower surface inclined to cause the force exerted by the load that is normal to the surface to urge the arm to pivot toward the hook.

3. The sling hoist of claim 2 further provided with stop means to limit the pivotal movement of the releasing arm away from the hook and in which the center of gravity of the arm is located to cause the arm to pivot toward the stop means when the arm is supported by the body.

4. The sling hoist of claim 1 in which the releasing arm is provided with protuberances on its lower surface that engage the load to reduce slippage between the arm and the load.

* * * * *